US009465344B2

(12) United States Patent
Yabe

(10) Patent No.: US 9,465,344 B2
(45) Date of Patent: Oct. 11, 2016

(54) IMAGE FORMATION APPARATUS

(71) Applicant: Oki Data Corporation, Tokyo (JP)

(72) Inventor: Kerama Yabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/684,469

(22) Filed: Apr. 13, 2015

(65) Prior Publication Data

US 2015/0309461 A1 Oct. 29, 2015

(30) Foreign Application Priority Data

Apr. 24, 2014 (JP) ..... 2014-090490

(51) Int. Cl.
*G03G 15/00* (2006.01)
*B65H 35/06* (2006.01)

(52) U.S. Cl.
CPC ..... *G03G 15/6529* (2013.01); *B65H 35/06* (2013.01); *G03G 15/5062* (2013.01); *G03G 15/6564* (2013.01); *G03G 15/6582* (2013.01); *B65H 2301/51212* (2013.01); *B65H 2301/51512* (2013.01); *B65H 2511/512* (2013.01); *B65H 2513/106* (2013.01); *B65H 2553/414* (2013.01); *B65H 2801/06* (2013.01); *G03G 2215/00704* (2013.01); *G03G 2215/00814* (2013.01)

(58) Field of Classification Search
CPC ..... G03G 15/6529; G03G 15/6523; G03G 2215/00704; G03G 2215/00814; B41J 11/46; B26D 5/30
See application file for complete search history.

(56) References Cited

U.S. PATENT DOCUMENTS 5,281,993 A * 1/1994 Crochetierre ..... G03D 15/005 355/40
8,531,495 B2 * 9/2013 Yoshida ..... B41J 11/46 347/218
2010/0074635 A1 * 3/2010 Sakurai ..... B41J 11/46 399/16
2011/0217108 A1 * 9/2011 Imamura ..... B41J 3/4075 400/583
2012/0010061 A1 * 1/2012 Sekino ..... B41J 13/0036 493/357

FOREIGN PATENT DOCUMENTS

JP H01-231745 A 9/1989
JP 2012-091437 A 5/2012

* cited by examiner

*Primary Examiner* — Jennifer Simmons
(74) *Attorney, Agent, or Firm* — Mots Law, PLLC

(57) ABSTRACT

An image formation apparatus includes: a conveyance unit provided to convey a long medium provided with conveyance indexes at a predetermined conveyance index spacing; a print unit provided to perform printing on the medium; a cutter unit provided to cut the medium; an index detector provided to detect the conveyance indexes; a print controller configured to drive the print unit to perform printing in response to detection of the conveyance indexes; a cut controller configured to cause the cutter unit to cut the medium in response to detection of the conveyance indexes; and a conveyance controller configured to form a slack in the medium by driving the conveyance unit. The print controller performs printing based on a virtual conveyance index when the medium having the slack is cut.

18 Claims, 13 Drawing Sheets

IMAGE FORMATION APPARATUS

CROSS REFERENCE TO RELATED APPLICATIONS

This application claims priority based on 35 USC 119 from prior Japanese Patent Application No. 2014-090490 filed on Apr. 24, 2014, entitled "IMAGE FORMATION APPARATUS", the entire contents of which are incorporated herein by reference.

BACKGROUND OF THE INVENTION

1. Field of the Invention

This disclosure relates to an image formation apparatus.

2. Description of Related Art

Among conventional image formation apparatuses such as printers, copiers, facsimiles, and multifunction printers, there is a printer, for example, which performs printing on long paper as a medium on which black marks are arranged at equal pitches in the medium's lengthwise direction. This type of printer is configured to set a print start position at which the printing starts on a paper conveyance route when a black mark sensor provided to a main body of the printer, i.e., an apparatus main body detects a black mark before the printing starts. A print unit starts the printing when a predetermined point of the paper arrives at the print start position.

Further, the printer is provided with a cutter unit at a predetermined position upstream of the print unit on the paper conveyance route. The printer with the cutter unit is configured to set a cut position that indicates where to cut the paper on the paper conveyance route when the black mark sensor detects a black mark after completion of the predetermined printing. The printer with the cutter unit is further configured to stop and cut the paper at the cut position by means of the cutter unit when a predetermined point of the paper arrives at the cut position.

However, this type of printer may fail to detect a black mark at the appropriate timing if a conveyance roller or the like of a conveyance unit for conveying the paper slips, or if a paper jam occurs.

When a black mark is not detected, the paper is stopped, and an operator of the printer is notified that the black mark is not detected, i.e., is notified of the occurrence of a black-mark detection error (see, for example, Japanese Patent Application Publication No. 2012-91437).

Meanwhile, there has also been provided a printer configured to make a paper slack between the print unit and the cut position on the paper conveyance route. This type of printer has no need to stop the paper at the cut position for the purpose of cutting the paper. Therefore, the print unit can stably perform the printing (see, for example, Japanese Patent Application Publication No. H1-231745).

SUMMARY OF THE INVENTION

However, in the above-described conventional type of printer, when performing a detection of the black marks on slacked paper, the black mark sensor, if disposed in proximity to the cut position, may fail to detect a black mark formed on a slacked part of the paper, and in this case may cause a black-mark detection error by mistake. As a result, the paper is stopped so that printing cannot be performed.

To address this problem, it is conceivable to dispose the black mark sensor at a position away from the cut position, but this increases the size of the printer.

It is an object of an embodiment of the invention to provide an image formation apparatus capable of stably performing printing as well as being downsized.

An aspect of an aspect of the invention is an image formation apparatus that includes: a conveyance unit provided to convey a long medium provided with conveyance indexes at a predetermined conveyance index spacing; a print unit provided to perform printing on the medium; a cutter unit provided to cut the medium; an index detector provided to detect the conveyance indexes; a print controller configured to drive the print unit to perform printing in response to detection of the conveyance indexes; a cut controller configured to cause the cutter unit to cut the medium in response to a detection of the conveyance indexes; and a conveyance controller configured to form slack in the medium by driving the conveyance unit. The print controller performs the printing based on a virtual conveyance index when the medium having the slack is cut.

According to this aspect, the print controller allows printing based on the virtual conveyance index, and cutting of the medium in the state in which slack is formed, and therefore, printing can be stably performed.

In addition, the index detector provided to detect the conveyance index can be disposed in proximity to a position where the cutter unit is disposed, and therefore, the image formation apparatus can be downsized.

DETAILED DESCRIPTION OF EMBODIMENTS

Figure 1:
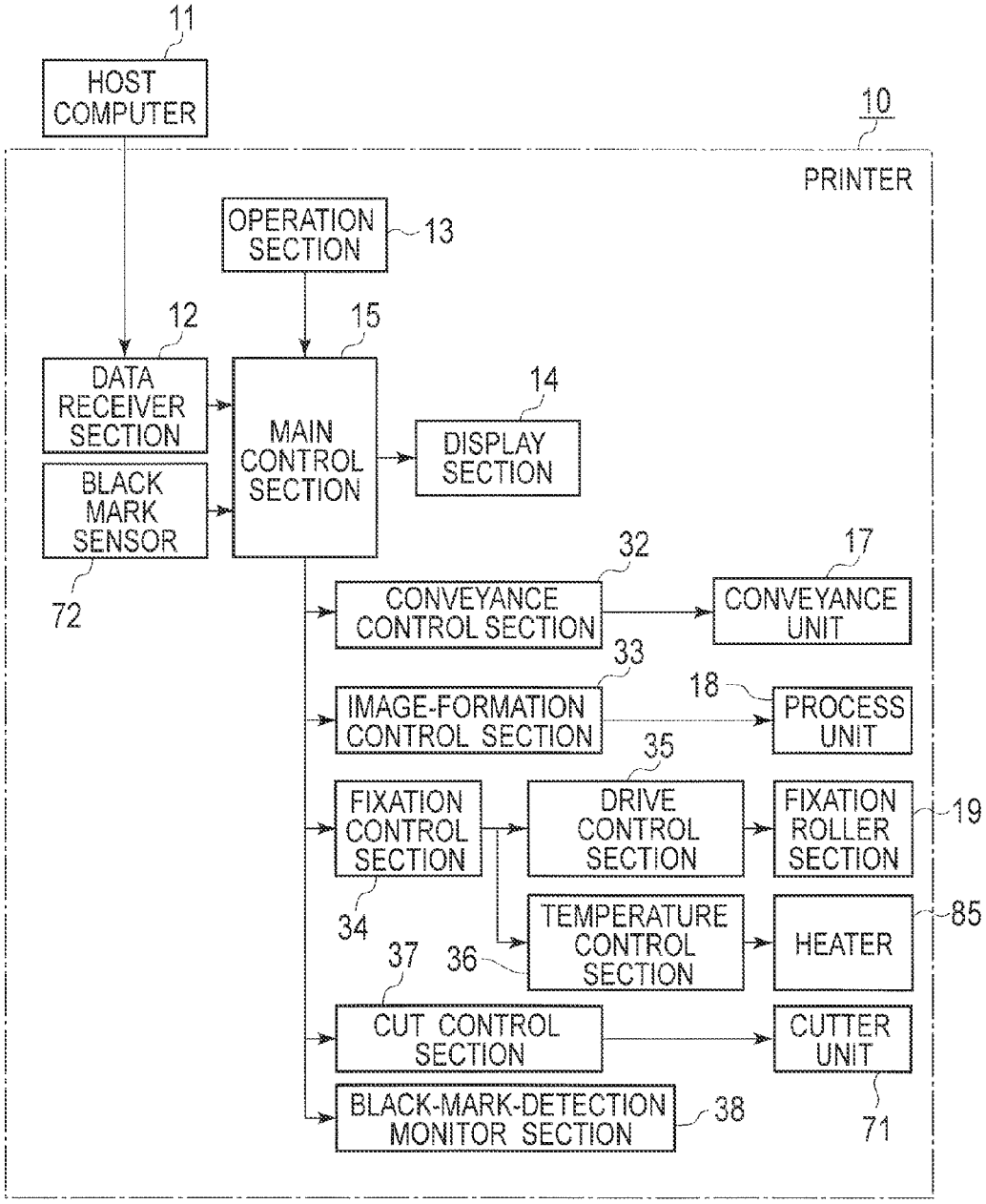
FIG. 1 is a control block diagram of a printer in an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

An embodiment of the invention is described in detail below with reference to the drawings. In this embodiment, a printer serving as an image formation apparatus is described.

Figure 2:
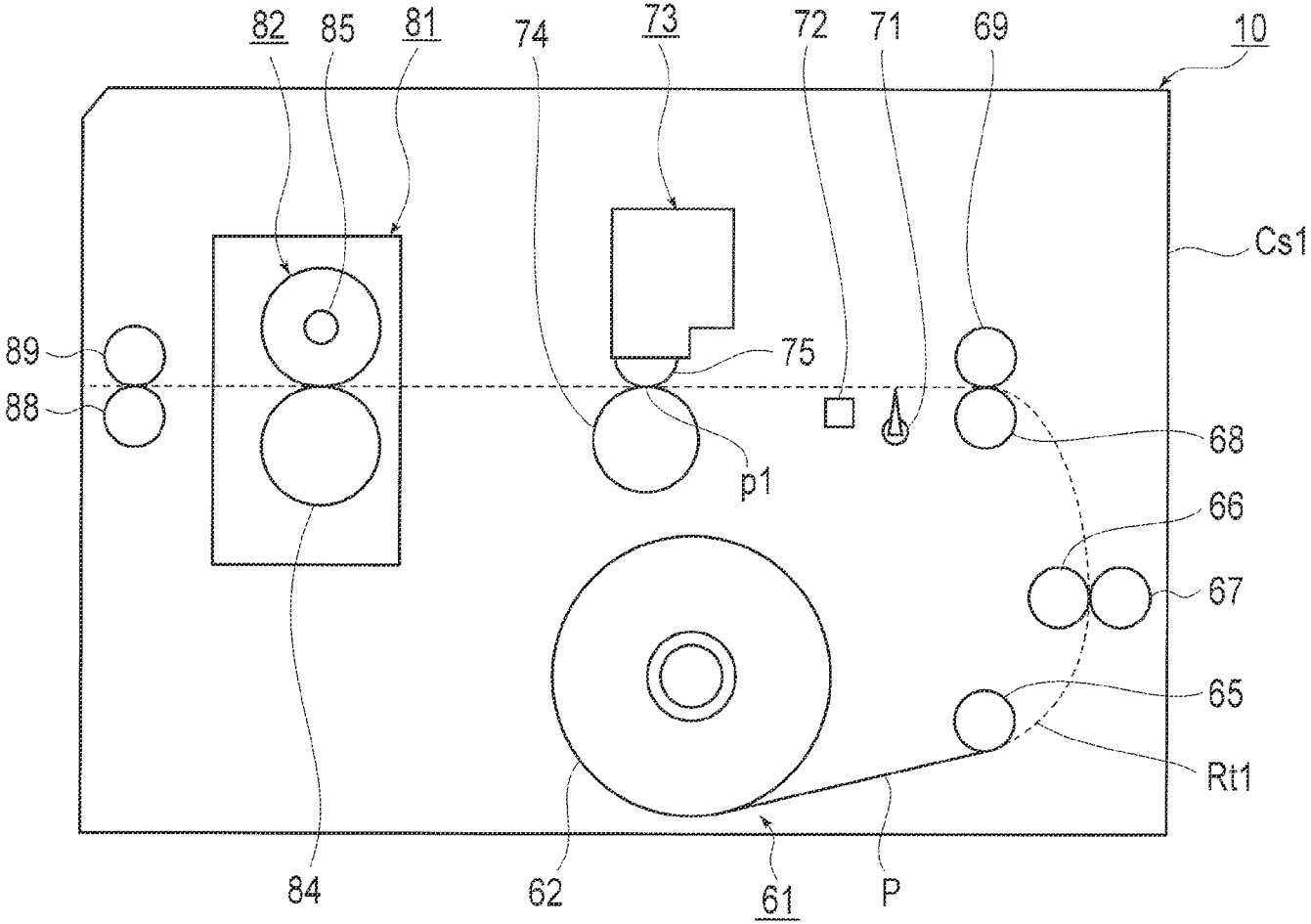
FIG. 2 is a schematic diagram of the printer in the embodiment of the invention.
Figure 3:
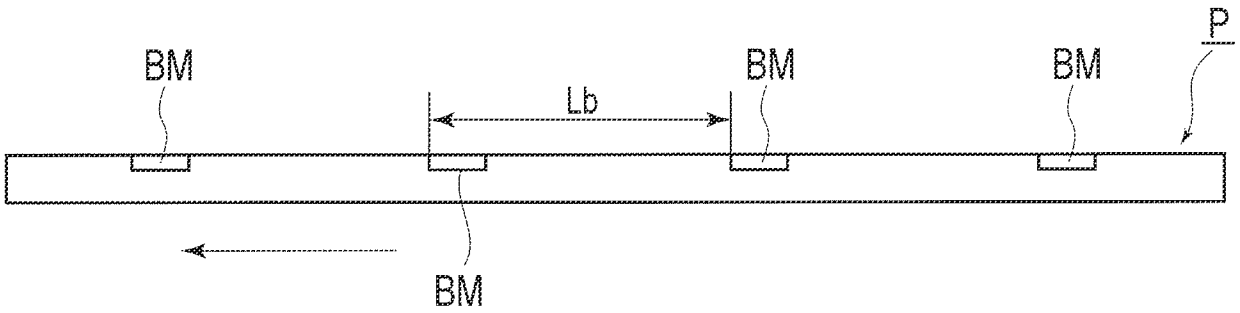
FIG. 3 is a diagram illustrating an example of paper in the embodiment of the invention.

FIG. 2 is a schematic diagram of the printer in the embodiment of the invention, and FIG. 3 is a diagram illustrating an example of paper in the embodiment of the invention.

In FIG. 2, printer 10 includes casing Cs1 and medium housing section 61. Roll paper 62 formed by winding long paper P as a medium is set in medium housing section 61. Printer 10 further includes feed roller 65, registration rollers 66 and 67, and conveyance rollers 68 and 69. Feed roller 65 is provided to feed paper P unrolled from medium housing section 61, to medium conveyance route Rt1. Registration rollers 66 and 67 are disposed downstream of feed roller 65 on medium conveyance route Rt1 to correct an oblique motion of paper P fed by feed roller 65. Conveyance rollers 68 and 69 are disposed downstream of registration rollers 66 and 67 on medium conveyance route Rt1 to convey paper P sent from registration rollers 66 and 67. Paper P is conveyed while being held between registration rollers 66 and 67, and between conveyance rollers 68 and 69.

Printer 10 further includes cutter unit 71 and black mark sensor 72. Cutter unit 71 is disposed downstream of conveyance rollers 68 and 69 on medium conveyance route Rt1, and serves as a cut device provided to cut paper P. Black mark sensor 72 is disposed downstream of cutter unit 71 on medium conveyance route Rt1, and serves as an index detector that detects black mark BM serving as an index representing an amount of conveyed paper P, namely, a conveyance index. For example, cutter unit 71 includes a movable blade (not illustrated) serving as a first blade and a fixed blade (not illustrated) serving as a second blade, and cuts paper P by sliding or pressing the movable blade against the fixed blade. Further, black mark sensor 72 is configured of a reflection-type optical sensor. Black mark sensor 72 emits light to a backside of paper P, and detects black marks BM, which are aligned with predetermined pitches on the backside of paper P, based on an amount of reflected light.

A distance between black marks BM, that is, a distance between the leading ends of respective black marks BM in this embodiment, is black mark spacing Lb serving as a conveyance index spacing. Black mark spacing Lb is set at a constant value to be equal to a distance in which paper P is conveyed in the arrow direction for printing print data for one data length.

Printer 10 further includes image formation unit 73 and transfer roller 74. Image formation unit 73 is disposed at an image formation part provided downstream of black mark sensor 72 on medium conveyance route Rt1. Transfer roller 74 is disposed to face image formation unit 73 and serves as a transfer member. Image formation unit 73 is configured of an electrophotographic process unit, and forms a toner image serving as a developer image on a surface of photosensitive drum 75 serving as an image carrier, by using a development device (not illustrated). Transfer roller 74 transfers the formed toner image to paper P. Transfer part p1 is formed between photosensitive drum 75 and transfer roller 74.

In a printer that performs color printing, image formation units of the respective colors of black, yellow, magenta, and cyan are disposed at an image formation part. Toner images of the respective colors are formed on photosensitive drums of the respective image formation units, and then sequentially transferred to paper P by the respective transfer rollers to be superimposed one upon another, so that a toner image of these colors is formed on paper P.

Printer 10 further includes fuser 81 disposed downstream of image formation unit 73 on medium conveyance route Rt1 and serving as a fixation device. Fuser 81 includes heat roller 82 serving as a first fixation member and pressure roller 84 serving as a second fixation member. Heater 85 serving as a heat body is disposed in heat roller 82. On paper P to which the toner image is transferred, the toner image is heated by heat roller 82 and pressurized by pressure roller 84 in fuser 81, so that an image is formed on paper P. Paper P where the image is formed is discharged to outside of the main body of printer 10, namely, an apparatus main body, by discharge rollers 88 and 89 disposed downstream of fuser 81 on medium conveyance route Rt1.

Next, a control device of printer 10 is described.

Figure 4:
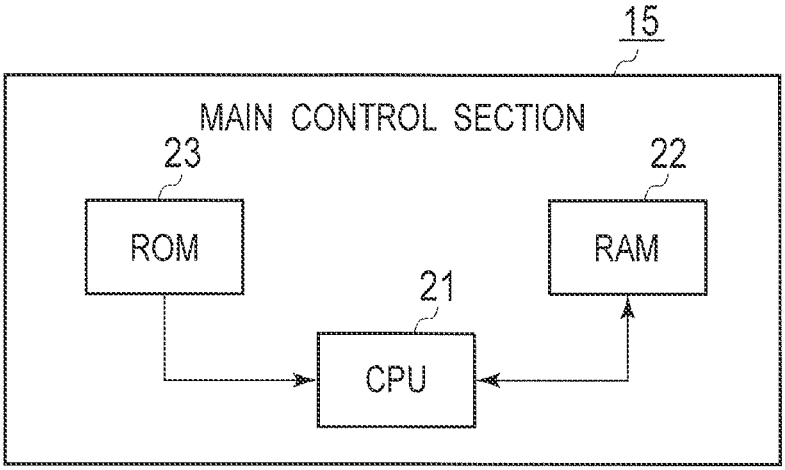
FIG. 4 is a control block diagram of a main control section in the embodiment of the invention.

FIG. 1 is a control block diagram of the printer in the embodiment of the invention, and FIG. 4 is a control block diagram of a main control section in the embodiment of the invention.

FIG. 1 illustrates printer 10 and host computer 11 serving as a higher device. Printer 10 includes data receiver section 12 connected to host computer 11, to receive print data, commands, and the like from host computer 11. Printer 10 further includes operation section 13 and display section 14. Operation section 13 includes an operation panel (not illustrated) and the like to be operated by an operator. Display section 14 includes an operation panel (not illustrated) and the like to display a status of printer 10, a result of operation performed on operation section 13, and the like. Printer 10 further includes main control section 15 that controls the entire printer 10. As illustrated in FIG. 4, main control section 15 includes components such as central processing unit (CPU) 21 serving as an arithmetic device, random access memory (RAM) 22 serving as a first storage device, and read only memory (ROM) 23 serving as a second storage device. RAM 22 is configured to record data necessary for operation of CPU 21, e.g., black-mark-spacing monitor variable FD, one after another. ROM 23 is configured to record a control program, set values such as error threshold $\epsilon$, and the like. Error threshold $\epsilon$ serves as a threshold to determine whether a black-mark detection error serving as a conveyance-index detection error occurs.

Printer 10 further includes conveyance unit 17, process unit 18, fixation roller section 19, cutter unit 71, black mark sensor 72, and heater 85. Conveyance unit 17 includes rollers for conveyance, such as feed roller 65, registration rollers 66 and 67, conveyance rollers 68 and 69, and discharge rollers 88 and 89. Process unit 18 includes image formation elements such as image formation unit 73 and transfer roller 74. Fixation roller section 19 includes rollers for heating, such as heat roller 82 and pressure roller 84.

Printer 10 further includes conveyance control section 32. Conveyance control section 32 drives conveyance unit 17 based on an instruction of main control section 15, so that feed roller 65 rotates to feed paper P, registration rollers 66 and 67 correct an oblique motion of paper P, conveyance rollers 68 and 69 rotate to convey paper P, and discharge rollers 88 and 89 discharge paper P to the outside of the apparatus main body.

Printer 10 further includes image-formation control section 33. Image-formation control section 33 drives process unit 18 based on an instruction of main control section 15, so that image formation unit 73 forms a toner image on the surface of photosensitive drum 75, and transfer roller 74 transfers the toner image to paper P.

Printer 10 further includes fixation control section 34. Fixation control section 34 controls drive control section 35 and temperature control section 36 based on an instruction of main control section 15, so that drive control section 35 drives fixation roller section 19 to rotate heat roller 82 and pressure roller 84, and temperature control section 36 drives heater 85 to heat up heat roller 82.

Image-formation control section 33, fixation control section 34, drive control section 35, and temperature control section 36 are used to configure a print controller. Process unit 18, fixation roller section 19, and heater 85 are used to configure a print unit. The print controller performs printing on paper P by driving the print unit based on an instruction from main control section 15.

Printer 10 further includes cut control section 37. Cut control section 37 drives cutter unit 71 based on an instruction of main control section 15, and cuts paper P by using the movable blade and the fixed blade.

Printer 10 further includes black-mark-detection monitor section 38 serving as a conveyance-index-detection monitor unit. Black-mark-detection monitor section 38 monitors the detection of black mark BM by black mark sensor 72, based on an instruction from main control section 15.

Next, operation of printer 10 thus configured is described.

Figure 5:
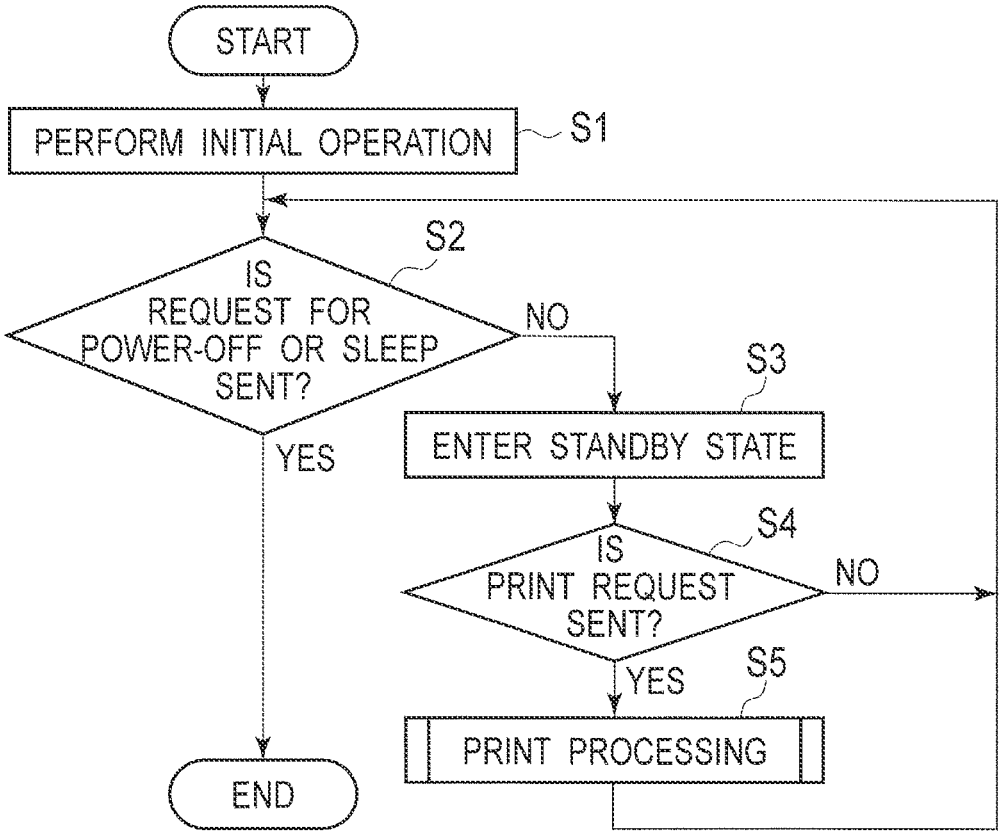
FIG. 5 is a main flowchart illustrating operation of the printer in the embodiment of the invention.

FIG. 5 is a main flowchart illustrating the operation of printer 10 in the embodiment of the invention.

First, main control section 15 determines whether a request for power-on or return-from-sleep of printer 10 is sent by an operation performed on operation section 13 by an operator. If a request for power-on or return-from-sleep of printer 10 is sent, printer 10 starts the control to perform the initial operation.

Upon completion of the initial operation, main control section 15 determines whether a request for power-off or sleep of printer 10 is sent by an operation performed on operation section 13 by the operator. If a request for power-off or sleep of printer 10 is sent, main control section 15 terminates the processing. If a request for power-off or sleep of printer 10 is not sent, main control section 15 performs the control for allowing printer 10 to enter a standby state.

Next, main control section 15 determines whether a print request is sent from data receiver section 12 or operation section 13. If a print request is not sent, main control section 15 determines again whether a request for power-off or sleep of printer 10 is sent by an operation performed on operation section 13 by the operator. If a request for power-off or sleep of printer 10 is sent, main control section 15 terminates the processing. If a request for power-off or sleep of printer 10 is not sent, main control section 15 performs the control for allowing printer 10 to enter a standby state.

On the other hand, if a print request is sent, main control section 15 acquires print information including print target temperature tm and print speed vp from data receiver section 12 or operation section 13. Main control section 15 then sends an instruction to fixation control section 34, so that fixation control section 34 warms up fuser 81. Main control section 15 subsequently sends instructions to conveyance control section 32 and image-formation control section 33 to drive conveyance unit 17 and process unit 18, respectively, so that print processing is performed.

Upon completion of the print processing, main control section 15 determines again whether a request for power-off or sleep of printer 10 is sent by an operation performed on operation section 13 by the operator. If a request for power-off or sleep of printer 10 is sent, main control section 15 terminates the processing. If a request for power-off or sleep of printer 10 is not sent, main control section 15 performs the control for allowing printer 10 to enter a standby state.

Next, the flowchart is described. In step S1, main control section 15 performs the initial operation. In step S2, main control section 15 determines whether a request for power-off or sleep of printer 10 is sent. Main control section 15 terminates processing if a request for power-off or sleep of printer 10 is sent, whereas main control section 15 proceeds to step S3 if a request for power-off or sleep of printer 10 is not sent. In step S3, main control section 15 allows printer 10 to enter a standby state. In step S4, main control section 15 determines whether a print request is sent. Main control section 15 proceeds to step S5 if a print request is sent, whereas main control section 15 returns to step S2 if a print request is not sent. In step S5, main control section 15 performs print processing and then returns to step S2.

Described next are print processing by conveyance control section 32 and image-formation control section 33, and black-mark-detection monitor processing, which serves as a conveyance-index-detection monitor processing, by black-mark-detection monitor section 38. In this embodiment, the print processing and the black-mark-detection monitor processing are performed in parallel.

Figure 6:
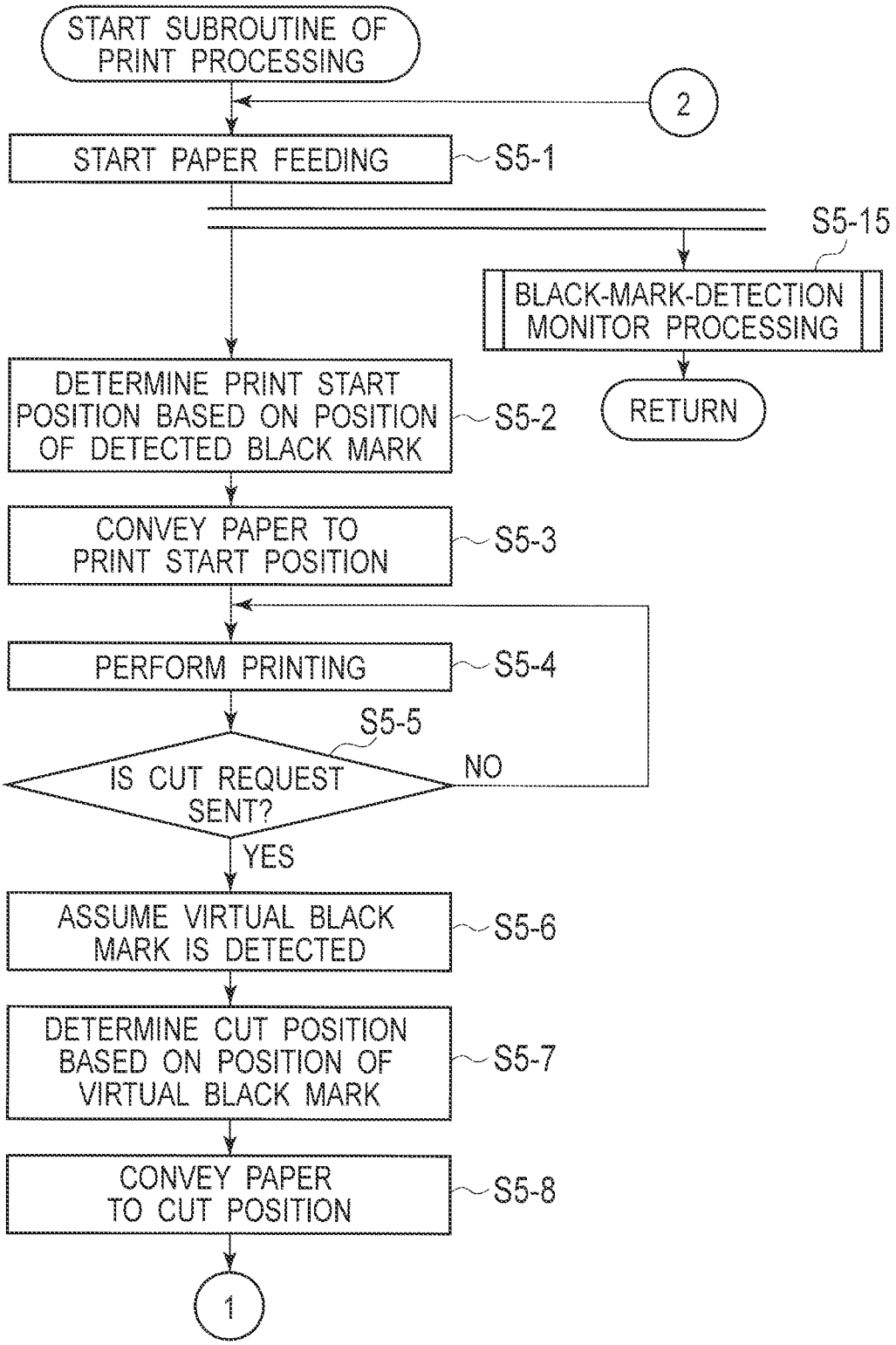
FIG. 6 is a first diagram illustrating a subroutine of the print processing in the embodiment of the invention.
Figure 7:
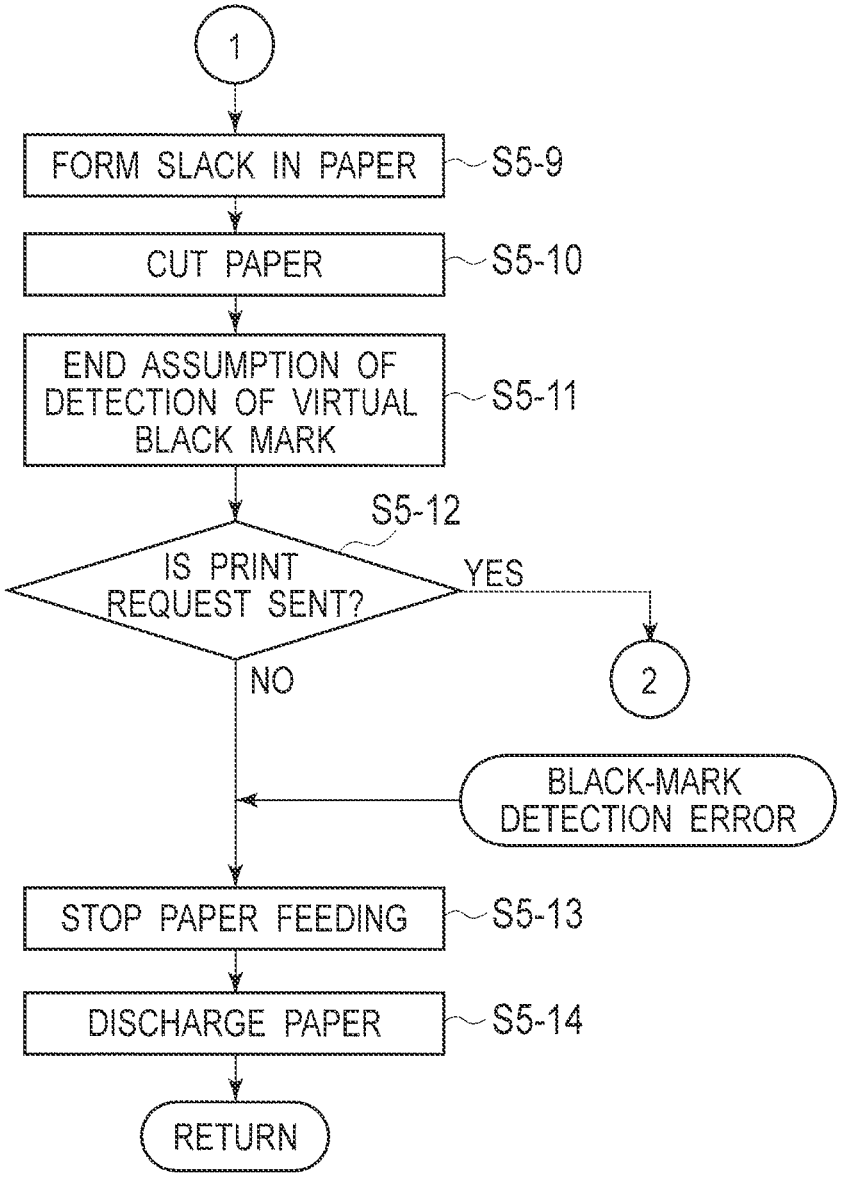
FIG. 7 is a second diagram illustrating the subroutine of the print processing in the embodiment of the invention.
Figure 8:
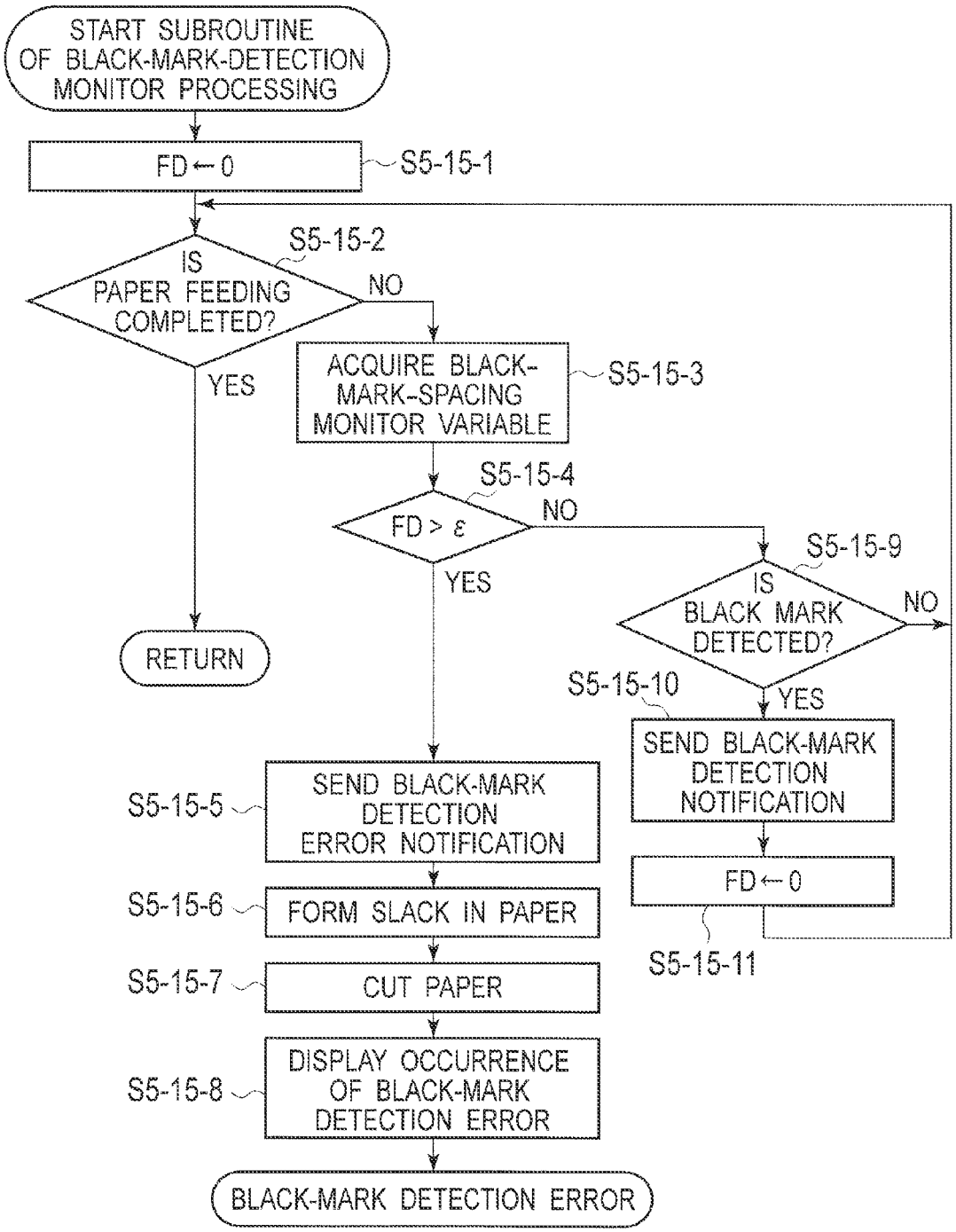
FIG. 8 is a diagram illustrating a subroutine of the black-mark-detection monitor processing in the embodiment of the invention.
Figure 9:
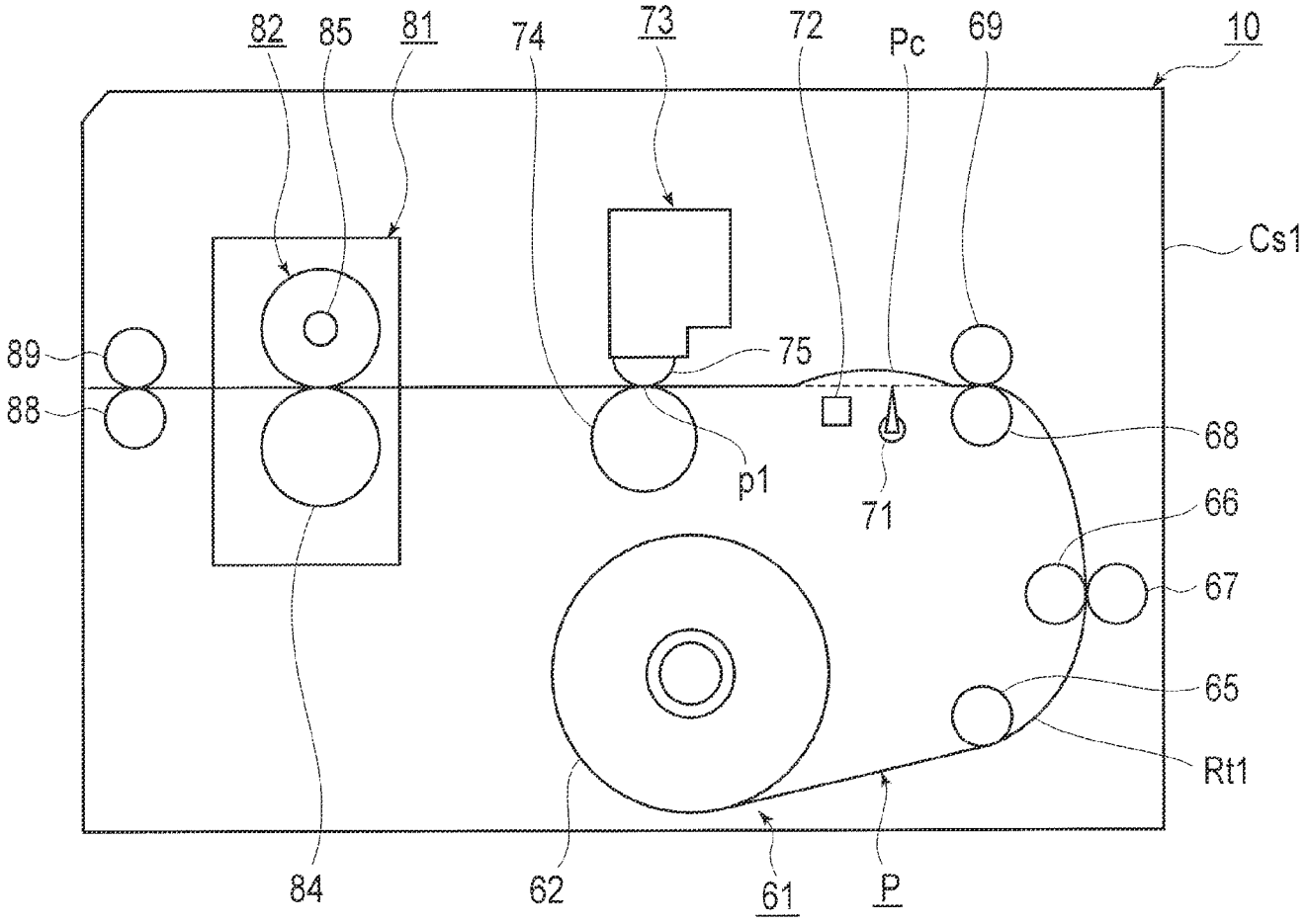
FIG. 9 is a diagram illustrating a state where slack is formed in the paper in the embodiment of the invention.

FIG. 6 is a first diagram illustrating a subroutine of the print processing in the embodiment of the invention. FIG. 7 is a second diagram illustrating the subroutine of the print processing in the embodiment of the invention. FIG. 8 is a diagram illustrating a subroutine of the black-mark-detection monitor processing in the embodiment of the invention. FIG. 9 is a diagram illustrating a state where slack is formed in the paper in the embodiment of the invention.

First, when main control section 15 sends an instruction to conveyance control section 32, conveyance control section 32 drives conveyance unit 17 to rotate feed roller 65 (FIG. 2) so that paper feeding begins. Upon start of the paper feeding, any oblique motion of paper P is corrected by registration rollers 66 and 67, and then paper P is conveyed by conveyance rollers 68 and 69.

Next, main control section 15 reads a sensor output of black mark sensor 72, and sends instructions to image-formation control section 33 and cut control section 37 when black mark BM is detected by black mark sensor 72. When printing is performed on paper P by image-formation control section 33 and then completed, cut control section 37 cuts paper P. During the printing, main control section 15 sends an instruction (a black-mark-detection monitor request) to black-mark-detection monitor section 38, to monitor detection of black mark BM by black mark sensor 72, so that the print processing and the black-mark-detection monitor processing are performed in parallel.

Meanwhile, there may be a case where black mark BM cannot be detected at an appropriate timing, due to the occurrence of a slip of a roller, such as feed roller 65, registration rollers 66 and 67, and conveyance rollers 68 and 69 of conveyance unit 17, or the occurrence of a paper jam.

Therefore, in this embodiment, if black mark BM cannot be detected in an appropriate timing, paper P is cut and a notification of the occurrence of a black mark error is issued to an operator.

Therefore, in the black-mark-detection monitor processing, main control section 15 first initializes black-mark-spacing monitor variable FD, which serves as a conveyance-index-spacing monitor variable, recorded in RAM 22 to "0". Black-mark-spacing monitor variable FD is a variable for monitoring for detection of the next black mark BM, after black mark BM is detected. In this embodiment, black-mark-spacing monitor variable FD is expressed by a distance in which paper P is conveyed during a time elapsing after the detection of black mark BM, namely, a medium conveyance distance. The time elapsing after detection of black mark BM can be used as a black-mark-spacing monitor variable FD.

Next, main control section 15 determines whether the paper feeding is completed based on whether a paper-feed end notification is sent from conveyance control section 32. If the paper feeding is completed, black-mark-detection monitor section 38 sends a black-mark-detection monitor end notification to main control section 15, and this ends the black-mark-detection monitor processing.

On the other hand, if a paper-feed end notification is not sent from conveyance control section 32, i.e., if the paper feeding is not completed, black-mark-detection monitor section 38 acquires print speed vp and control time Tc from conveyance control section 32. Control time Tc represents a time during which control by conveyance control section 32 is performed after detection of black mark BM. Based on print speed vp and control time Tc, black-mark-detection monitor section 38 calculates black-mark-spacing monitor variable FD, FD=vp·Tc, and records a result of this calculation in RAM 22 to update black-mark-spacing monitor variable FD.

Next, black-mark-detection monitor section 38 acquires black-mark-spacing monitor variable FD by reading this black-mark-spacing monitor variable FD from RAM 22, and reads error threshold ϵ from ROM 23. Black-mark-detection monitor section 38 then determines whether a black-mark detection error occurs, based on whether black-mark-spacing monitor variable FD is greater than error threshold ϵ.

In this embodiment, each black mark spacing Lb (FIG. 3) is set to be equal to the distance in which paper P is conveyed for printing print data for one data length and therefore, error threshold ϵ is set at a value determined by adding margin distance mg to this distance.

If black-mark-spacing monitor variable FD is greater than error threshold ϵ, i.e., if a black-mark detection error occurs, black-mark-detection monitor section 38 sends a black-mark detection error notification to main control section 15.

Next, when main control section 15 sends an instruction to conveyance control section 32 based on the black-mark detection error, conveyance control section 32 drives conveyance unit 17, so that conveyance peripheral velocity VH of feed roller 65, registration rollers 66 and 67, and conveyance rollers 68 and 69 becomes higher than peripheral velocity VS of photosensitive drum 75 and transfer roller 74. As a result, slack Pc corresponding to a velocity difference ΔV, i.e., ΔV=VH−VS, as illustrated in FIG. 9, is formed in paper P between transfer part p1 and conveyance rollers 68 and 69 on medium conveyance route Rt1.

Next, when main control section 15 sends an instruction to cut control section 37, cut control section 37 drives cutter unit 71 to cut paper P. Further, main control section 15 allows display section 14 to display the occurrence of the black-mark detection error. Main control section 15 subsequently sends an instruction to conveyance control section 32, so that conveyance control section 32 drives conveyance unit 17, to halt the paper feeding by stopping feed roller 65, and to discharge paper P to the outside of the apparatus main body by rotating discharge rollers 88 and 89.

Afterwards, a print request from data receiver section 12 or operation section 13 is interrupted, and the printing is suspended, until the black-mark detection error is cleared by, for example, opening a cover of printer 10.

In this way, when black mark BM cannot be detected in an appropriate timing due to the occurrence of a slip of a roller such as feed roller 65, registration rollers 66 and 67, and conveyance rollers 68 and 69 of conveyance unit 17, or the occurrence of a paper jam, an occurrence of a black-mark detection error is determined, and printing is suspended.

On the other hand, if black-mark-spacing monitor variable FD is equal to or less than error threshold ϵ, i.e., if there is no occurrence of a black-mark detection error, main control section 15 reads a sensor output of black mark sensor 72 and determines whether black mark BM is detected by black mark sensor 72.

Subsequently, if black mark BM is not detected, black-mark-detection monitor section 38 acquires black-mark-spacing monitor variable FD, and repeats the above-described processing, until the paper feeding ends.

On the other hand, if black mark BM is detected, main control section 15 sends a black-mark detection notification to black-mark-detection monitor section 38, image-formation control section 33, and cut control section 37, and initializes black-mark-spacing monitor variable FD to "0". Afterwards, black-mark-detection monitor section 38 acquires black-mark-spacing monitor variable FD, and the above-described processing is repeated until the paper feeding ends.

Meanwhile, when black mark BM is detected in the print processing performed parallel to the black-mark-detection monitor processing, main control section 15 reads a position of black mark BM, and then determines a print start position based on the position of detected black mark BM. Main control section 15 then sends an instruction to conveyance control section 32, so that conveyance control section 32 drives conveyance unit 17 to convey paper P to the print start position. Main control section 15 also sends an instruction to image-formation control section 33, so that image-formation control section 33 drives process unit 18 to perform printing for forming an image on paper P.

Further, main control section 15 determines whether a cut request is sent from data receiver section 12 or operation section 13. If a cut request is not sent, the printing is performed until a cut request is sent. If a cut request is sent, main control section 15 assumes that a virtual black mark, namely, virtual black mark BM' is detected, and sends a virtual-black-mark detection notification to black-mark-detection monitor section 38.

When a virtual distance that is a spacing of virtual black marks BM' is virtual black mark spacing Lb', virtual black mark BM' is equal to black mark spacing Lb, or is an average value of previous black-mark-spacing monitor variables FD at the time of black-mark-BM detection.

Next, main control section 15 reads a position of virtual black mark BM' assumed to be detected, and then determines a cut position based on the position of virtual black mark BM'. Main control section 15 then sends an instruction to conveyance control section 32, so that conveyance control section 32 drives conveyance unit 17 to convey paper P to the cut position, and sets conveyance peripheral velocity VH of feed roller 65, registration rollers 66 and 67, and conveyance rollers 68 and 69 to be higher than peripheral velocity VS of photosensitive drum 75 and transfer roller 74. As a result, slack Pc corresponding to a velocity difference ΔV, i.e., ΔV=VH−VS, is formed in paper P between transfer part p1 and conveyance rollers 68 and 69 on medium conveyance route Rt1.

Main control section 15 subsequently sends an instruction to cut control section 37 to cut paper P by driving cutter unit 71, and then ends the assumption of the detection of virtual black mark BM'. Afterwards, black mark sensor 72 detects black mark BM.

Next, main control section 15 determines whether a print request is sent from data receiver section 12 or operation section 13. If a print request is sent, main control section 15 sends an instruction to conveyance control section 32 again. Upon receiving this instruction, conveyance control section 32 drives conveyance unit 17 so that feed roller 65 rotates to perform paper feeding for the next printing.

If a print request is not sent from data receiver section 12 or from operation section 13, main control section 15 sends an instruction to conveyance control section 32 to drive conveyance unit 17, so that conveyance unit 17 stops feed roller 65 to halt the paper feeding, and rotates discharge rollers 88 and 89 to discharge paper P to the outside of the apparatus main body. As a result, the print processing ends.

In this way, unless a slip of a roller such as feed roller 65, registration rollers 66 and 67, conveyance rollers 68 and 69 of conveyance unit 17 and a paper jam occur every time black mark BM is detected at a predetermined timing, a print start position is determined, printing is performed, virtual black mark BM' is assumed to be detected, a cut position is determined, and then paper P is cut.

Therefore, even if slack Pc is formed in paper P, it is not determined that a black-mark detection error occurs, so that printing is not suspended.

When detection of virtual black mark BM' is completed after paper P is cut, black-mark-spacing monitor variable FD is initialized to "0". Therefore, unless a slip at a roller such as feed roller 65, registration rollers 66 and 67, conveyance rollers 68 and 69 of conveyance unit 17, or a paper jam occurs, black-mark-spacing monitor variable FD does not become greater than error threshold E, and thus, it is not determined that the black-mark detection error occurs.

Next, the flowcharts of FIGS. 6 and 7 are described. In step S5-1, conveyance control section 32 starts paper feeding. In step S5-2, main control section 15 determines a print start position, based on a position of the detected black mark BM. In step S5-3, conveyance control section 32 conveys paper P to the print start position. In step S5-4, image-formation control section 33 performs printing. In step S5-5, main control section 15 determines whether a cut request is sent. The processing proceeds to step S5-6 if a cut request is sent, while the processing returns to step S5-4 if a cut request is not sent. In step S5-6, main control section 15 assumes that virtual black mark BM' is detected at virtual black mark spacing Lb'. In step S5-7, main control section 15 determines a cut position, based on a position of virtual black mark BM' assumed to be detected. In step S5-8, conveyance control section 32 conveys paper P to the cut position. In step S5-9, conveyance control section 32 forms slack Pc in paper P. In step S5-10, cut control section 37 cuts paper P. In step S5-11, main control section 15 ends the assumption of the detection of virtual black mark BM'. In step S5-12, main control section 15 determines whether a print request is sent. The processing proceeds to step S5-13 if a print request is not sent, whereas the processing returns to step S5-1 if a print request is sent. In step S5-13, conveyance control section 32 stops the paper feeding. In step S5-14, conveyance control section 32 discharges paper P and then returns. In step S5-15, black-mark-detection monitor section 38 performs the black-mark-detection monitor processing, based on an instruction of main control section 15 and then returns.

Next, the flowchart of FIG. 8 is described. In step S5-15-1, main control section 15 initializes black-mark-spacing monitor variable FD to "0". In step S5-15-2, main control section 15 determines whether paper feeding is completed. The processing proceeds to step S5-15-3 if the paper feeding is not completed, whereas the processing returns if the paper feeding is completed. In step S5-15-3, black-mark-detection monitor section 38 acquires black-mark-spacing monitor variable FD. In step S5-15-4, black-mark-detection monitor section 38 determines whether black-mark-spacing monitor variable FD is greater than error threshold $\epsilon$. The processing proceeds to step S5-15-5 if black-mark-spacing monitor variable FD is greater than error threshold $\epsilon$, whereas the processing proceeds to step S5-15-9 if black-mark-spacing monitor variable FD is equal to or less than error threshold $\epsilon$. In step S5-15-5, black-mark-detection monitor section 38 sends a black-mark detection error notification. In step S5-15-6, conveyance control section 32 forms slack Pc in paper P. In step S5-15-7, cut control section 37 cuts paper P. In step S5-15-8, main control section 15 allows display section 14 to display the occurrence of a black-mark detection error. In step S5-15-9, main control section 15 determines whether black mark BM is detected. The processing proceeds to step S5-15-10 if black mark BM is detected, whereas the processing returns to step S5-15-2 if black mark BM is not detected. In step S5-15-10, main control section 15 sends a black-mark detection notification. In step S5-15-11, main control section 15 initializes black-mark-spacing monitor variable FD to "0", and then returns to step S5-15-2.

Next, a sequence representing the operation of printer 10 is described.

Figure 10:
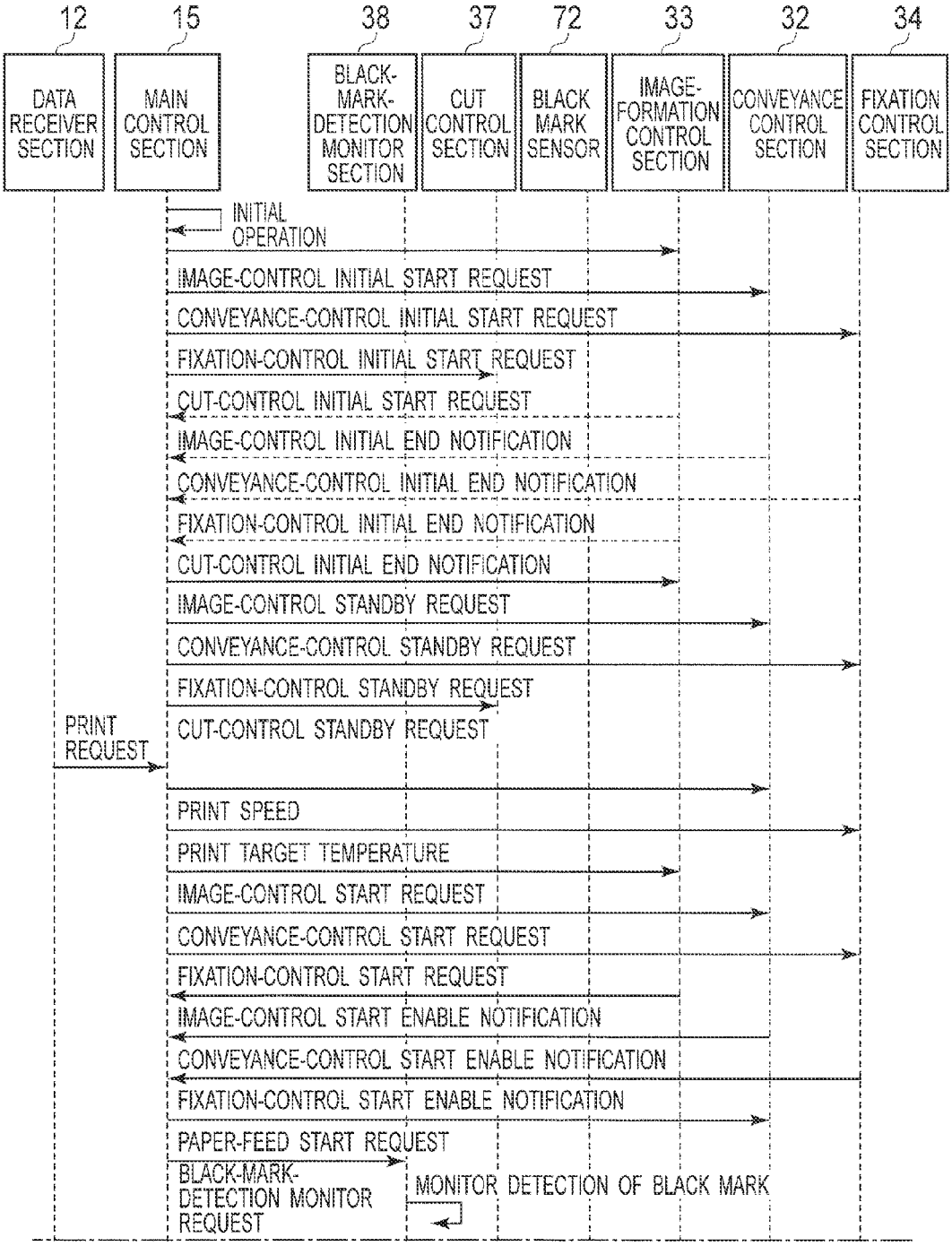
FIG. 10 is a first sequence diagram illustrating the operation of the printer in the embodiment of the invention.
Figure 11:
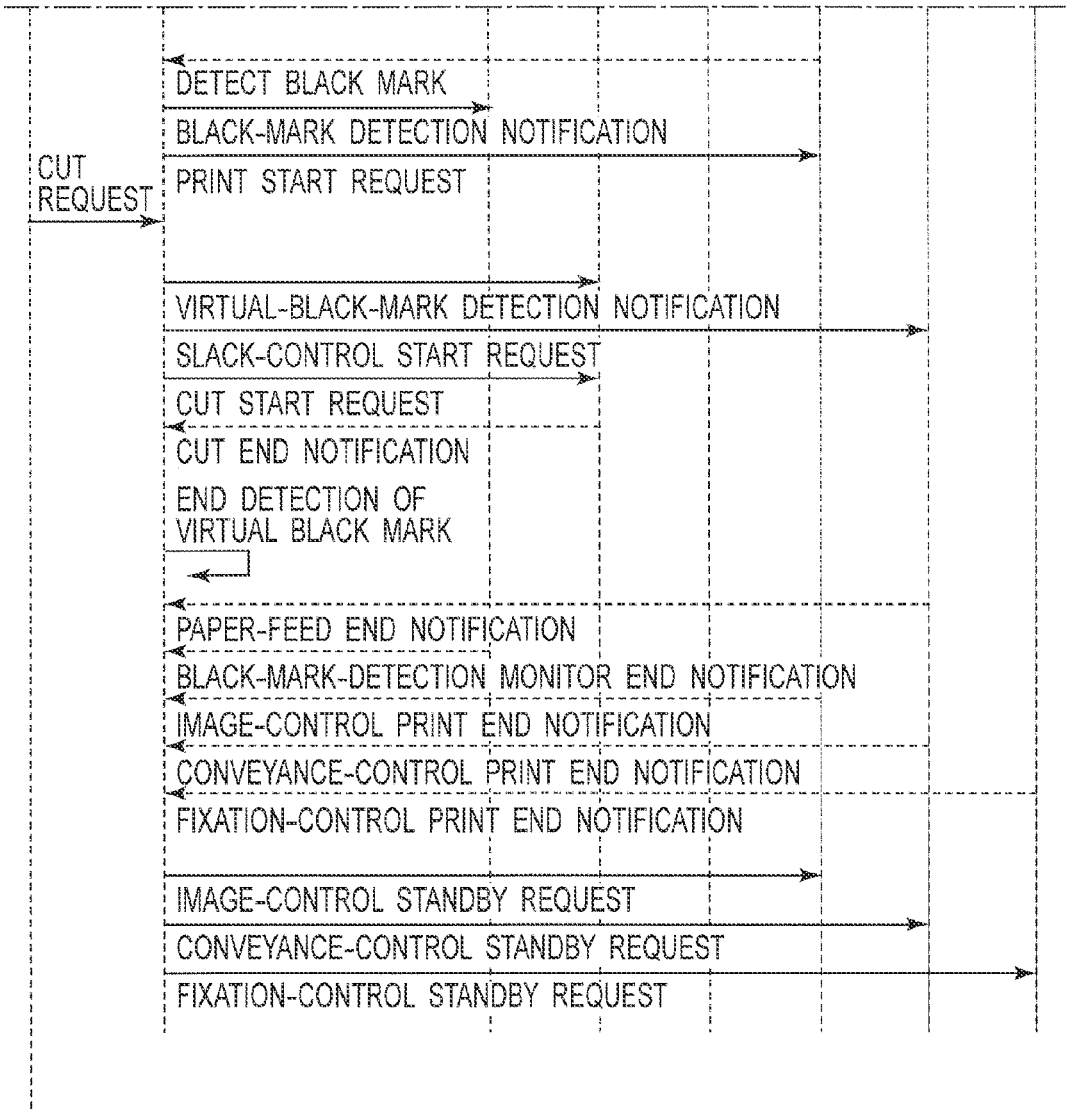
FIG. 11 is a second sequence diagram illustrating the operation of the printer in the embodiment of the invention.

FIG. 10 is a first sequence diagram illustrating the operation of the printer in the embodiment of the invention. FIG. 11 is a second sequence diagram illustrating the operation of the printer in the embodiment of the invention.

First, main control section 15 starts the initial operation, and sends an image-control initial start request to image-formation control section 33, a conveyance-control initial start request to conveyance control section 32, a fixation-control initial start request to fixation control section 34, and a cut-control initial start request to cut control section 37. Process unit 18 (FIG. 1), conveyance unit 17, fixation roller section 19, heater 85, and cutter unit 71 are thereby controlled to perform the initial operation.

Upon completion of the initial operation, an image-control initial end notification is sent from image-formation control section 33, a conveyance-control initial end notification is sent from conveyance control section 32, a fixation-control initial end notification is sent from fixation control section 34, and a cut-control initial end notification is sent from cut control section 37. Upon receiving these notifications, main control section 15 sends an image-control standby request to image-formation control section 33, a conveyance-control standby request to conveyance control section 32, a fixation-control standby request to fixation control section 34, and a cut-control standby request to cut control section 37.

Next, when a print request is sent from data receiver section 12 or from operation section 13 while printer 10 is in a standby state, main control section 15 determines print speed vp and print target temperature tm, and sends determined print speed vp and print target temperature tm to conveyance control section 32 and fixation control section 34, respectively.

Main control section 15 subsequently sends an image-control start request to image-formation control section 33, a conveyance-control start request to conveyance control section 32, and a fixation-control start request to fixation control section 34. In response to these requests, an image-control start enable notification is sent from image-formation control section 33, a conveyance-control start enable notification is sent from conveyance control section 32, and a fixation-control start enable notification is sent from fixation control section 34. Upon receiving these notifications, main control section 15 sends a paper-feed start request to conveyance control section 32 to drive conveyance unit 17 so that feed roller 65 rotates to perform paper feeding.

In addition, main control section 15 sends a black-mark-detection monitor request to black-mark-detection monitor section 38, to monitor a status of the detection of black mark BM by black mark sensor 72.

Next, when black mark sensor 72 detects black mark BM and then sends a sensor output to main control section 15, main control section 15 sends a black-mark detection notification to black-mark-detection monitor section 38. Upon receiving the black-mark detection notification from main control section 15, black-mark-detection monitor section 38 monitors the detection of black mark BM by black mark sensor 72, until the black-mark-detection monitor processing is completed.

In addition, main control section 15 reads a position of the detected black mark BM, and determines a print start position based on the position of black mark BM. Main control section 15 then sends a conveyance start request to conveyance control section 32, and also sends a print start request to image-formation control section 33 so that process unit 18 operates to perform printing.

Next, when a cut request is sent from data receiver section 12 or from operation section 13, main control section 15 sends a virtual-black-mark detection notification to cut control section 37, and also reads a position of the detected virtual black mark BM' and determines a cut position based on the position of virtual black mark BM'. Main control section 15 then sends the cut position and a slack-control start request to conveyance control section 32, and sends a cut start request to cut control section 37. Cut control section 37 thereby drives cutter unit 71 to cut paper P.

After paper P is cut, cut control section 37 sends a cut end notification to main control section 15, so that main control section 15 ends the detection of virtual black mark BM'.

Afterwards, a paper-feed end notification is sent from conveyance control section 32, a black-mark-detection monitor end notification is sent from black-mark-detection monitor section 38, an image-control print end notification is sent from image-formation control section 33, a conveyance-control print end notification is sent from conveyance control section 32, and a fixation-control print end notification is sent from fixation control section 34. Upon receiving these notifications, main control section 15 sends an image-control standby request to image-formation control section 33, a conveyance-control standby request to conveyance control section 32, and a fixation-control standby request to fixation control section 34, so that printer 10 enters a standby state.

Figure 12:
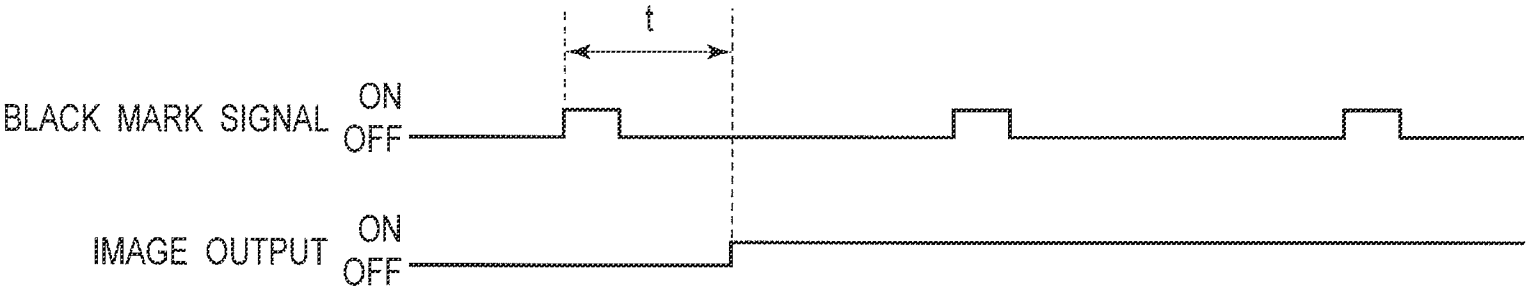
FIG. 12 is a time chart of a black mark signal and an image output in the embodiment of the invention.
Figure 13:
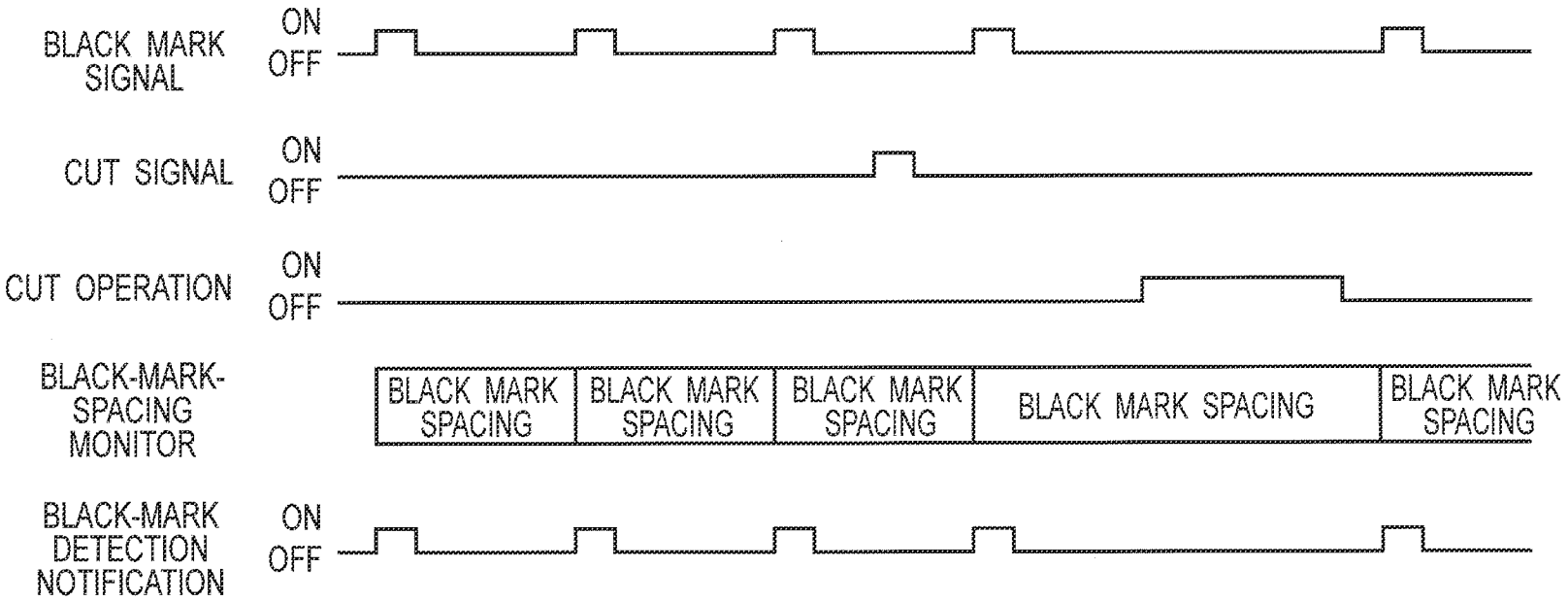
FIG. 13 is a time chart illustrating the operation of the printer when a virtual black mark is not used in the embodiment of the invention.
Figure 14:
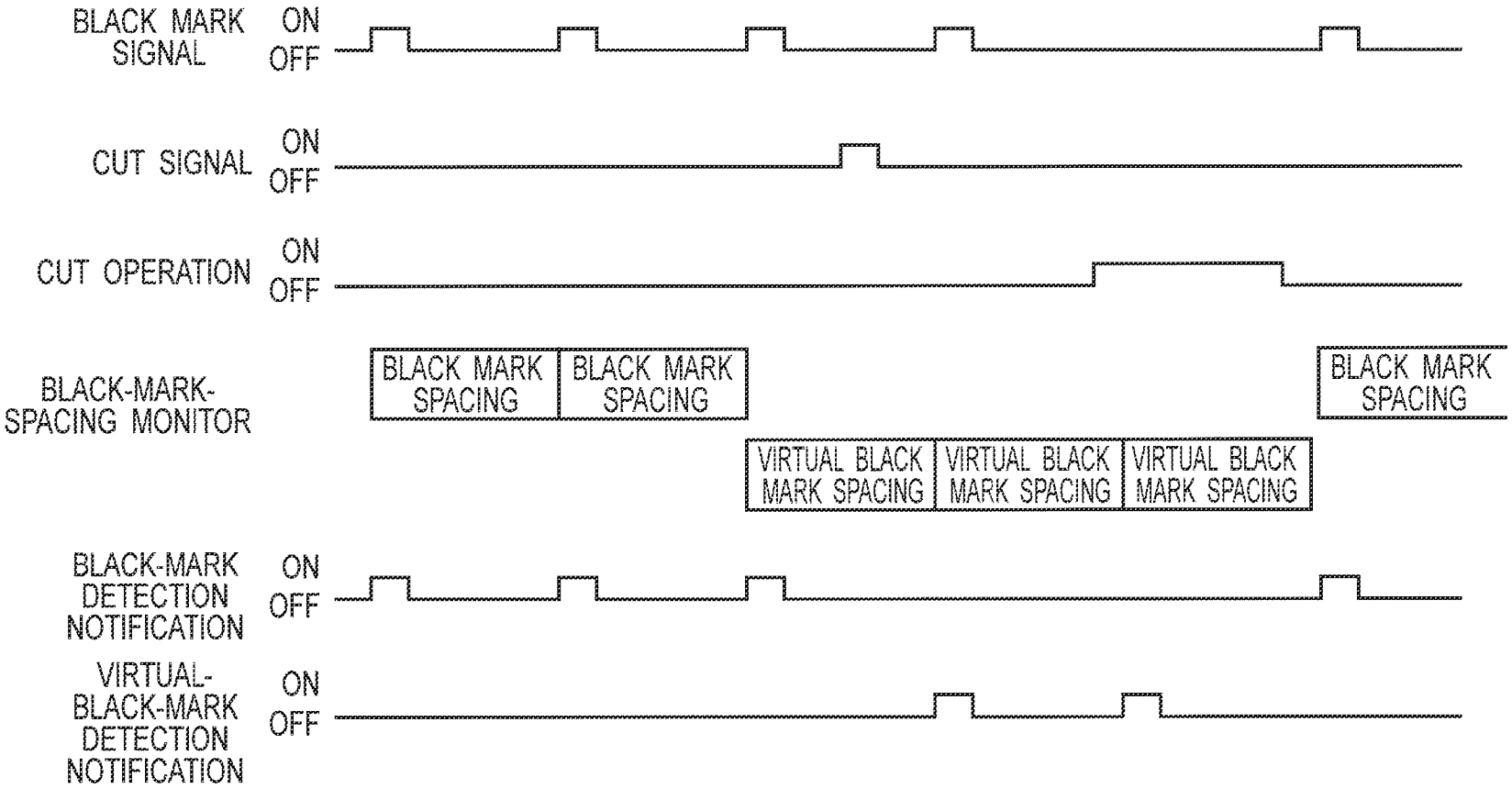
FIG. 14 is a time chart illustrating the operation of the printer when the virtual black mark is used in the embodiment of the invention.

FIG. 12 is a time chart of a black mark signal and an image output in the embodiment of the invention. FIG. 13 is a time chart illustrating the operation of printer 10 when virtual black mark BM' is not used in the embodiment of the invention. FIG. 14 is a time chart illustrating the operation of printer 10 when virtual black mark BM' is used in the embodiment of the invention.

Upon detection of black mark BM by black mark sensor 72 (FIG. 1), a black mark signal indicated by a sensor output of black mark sensor 72 is turned ON. As illustrated in FIG. 12, upon a lapse of time t after the black mark signal is turned ON, image-formation control section 33 is driven to drive process unit 18, so that an image output is turned ON.

When a distance by which paper P is conveyed during the lapse of time t after the detection of black mark BM is "Ln", a margin of distance Ln is formed at a leading end of paper P. Distance Ln and time t can be freely set. However, distance Ln is set as Lsc<Ln<Lb, that is, distance Ln is longer than sensor-cut distance Lsc and shorter than black mark spacing Lb, where sensor-cut distance Lsc is a distance between a position at which black mark sensor 72 is disposed and a position at which cutter unit 71 is disposed.

Next, the operation of printer 10 when virtual black mark BM' is not used is described based on FIG. 13.

Upon detection of black mark BM, a black mark signal is turned ON, and then main control section 15 sends a cut start request to cut control section 37 at a predetermined timing. As a result, a cut signal is turned ON to drive cutter unit 71, so that the cut operation is turned ON.

Meanwhile, upon detection of black mark BM, main control section 15 sends a black-mark detection notification to black-mark-detection monitor section 38. In response to this, black-mark-detection monitor section 38 is turned ON, initializes black-mark-spacing monitor variable FD to "0", and then monitors and calculates black mark spacing Lb.

In this case, if slack Pc is formed in paper P when paper P is cut, black mark sensor 72 cannot detect black mark BM, so that black mark spacing Lb becomes longer and black-mark-spacing monitor variable FD becomes greater which causes a black-mark detection error.

Next, the operation of printer 10 when virtual black mark BM' is used is described based on FIG. 14.

Upon detection of black mark BM, a black mark signal is turned ON, and then main control section 15 sends a cut start request to cut control section 37 at a predetermined timing. As a result, a cut signal is turned ON, to drive cutter unit 71 so that the cut operation is turned ON.

Meanwhile, upon detection of black mark BM, main control section 15 sends a black-mark detection notification to black-mark-detection monitor section 38. In response to this, black-mark-detection monitor section 38 is turned ON, initializes black-mark-spacing monitor variable FD to "0", and then monitors and calculates black mark spacing Lb.

In this case, when cut control section 37 turns ON a cut signal in response to reception of a cut start request sent from main control section 15, main control section 15 assumes that virtual black mark BM' is detected at virtual black mark spacing Lb', and sends a virtual-black-mark detection notification to black-mark-detection monitor section 38, and black-mark-detection monitor section 38 is turned ON.

Therefore, since it is assumed that virtual black mark BM' is detected while the cut operation is ON, it is possible to prevent a black-mark detection error from occurring by mistake.

Since paper P with slack Pc is cut, a trailing end of paper P and a leading end of a subsequent paper P after being cut may overlap each other. However, a margin of paper P overlaps a margin of a subsequent paper P and therefore, a disturbance on a toner image due to the overlapping of paper P is unlikely to occur. Accordingly, image degradation is avoided.

In this embodiment, in order to form slack Pc in paper P, conveyance peripheral velocity VH of feed roller 65, registration rollers 66 and 67, and conveyance rollers 68 and is set to be higher than peripheral velocity VS of photosensitive drum 75 and transfer roller 74. However, since black mark sensor 72 is disposed downstream of cutter unit 71, it is unlikely that, as peripheral velocity VH increases, the detection of black mark BM is delayed so that more paper P is conveyed and thus more paper P is used.

In addition, since black mark sensor 72 is disposed in proximity to the position where the printing is performed by process unit 18, the accuracy of detection of black mark sensor 72 can be enhanced.

As described above, in this embodiment, image-formation control section 33 and fixation control section 34 perform the printing based on virtual black mark BM' in the cutting of paper P in a state where slack Pc is formed, and therefore, the printing can be stably performed.

Moreover, since black mark sensor 72 is disposed in proximity to the cut position, printer 10 can be downsized.

In this embodiment, printer 10 is described, but the invention can be applied to image formation apparatuses such as a copier, a facsimile, and a multifunction printer.

The invention is not limited to the above-described embodiment, and various modifications of the invention are achievable based on the gist of the invention, without being excluded from the scope of the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

a conveyance unit provided to convey a long medium provided with conveyance indexes at a predetermined conveyance index spacing;

a print unit provided to perform printing on the medium;

a cutter unit provided to cut the medium;

an index detector provided to detect the conveyance indexes;

a print controller configured to drive the print unit to perform printing in response to a detection of the conveyance indexes;

a cut controller configured to cause the cutter unit to cut the medium in response to the detection of the conveyance indexes; and a conveyance controller configured to form a slack in the medium by driving the conveyance unit, wherein the print controller is configured to, during a period from reception of a cut request of the medium to a completion of the cut of the medium, set a virtual conveyance index in response to the cut request and perform a cutting operation by the cut controller based on the virtual conveyance index.

2. The image formation apparatus according to claim 1, further comprising a conveyance-index-detection monitor unit configured to determine whether or not a conveyance-index detection error occurs based on whether a conveyance-index-spacing monitor variable is greater than a threshold, the conveyance-index-spacing monitor variable being a variable for monitoring a detection of a subsequent conveyance index after a detection of a previous conveyance index, wherein when the conveyance-index detection error occurs, the conveyance controller drives the conveyance unit to form the slack in the medium, and the cut controller drives the cutter unit to cut the medium.

3. The image formation apparatus according to claim 1, wherein the print controller starts printing on the medium at a print start position determined based on a position of the conveyance index.

4. The image formation apparatus according to claim 1, wherein the cut controller cuts the medium at a cut position determined based on a position of the virtual conveyance index.

5. The image formation apparatus according to claim 1, wherein the index detector is disposed downstream of the cutter unit on a medium conveyance route.

6. The image formation apparatus according to claim 1, wherein a spacing of the virtual conveyance index is equal to the conveyance index spacing.

7. The image formation apparatus according to claim 1, wherein a spacing of the virtual conveyance index is set to an average value of conveyance-index-spacing monitor variables at times of detections of the previous conveyance indexes.

8. The image formation apparatus according to claim 1, wherein the virtual conveyance index is determined based on the previous conveyance indexes.

9. The image formation apparatus according to claim 1, wherein the print unit and the index detector are disposed in close proximity to each other with respect to the conveyance path of the medium as conveyed by the conveyance unit.

10. The image formation apparatus according to claim 1, wherein no medium conveyance components are disposed between the print unit and the index detector along the conveyance path of the medium.

11. The image formation apparatus according to claim 1, wherein the cutter unit, the index detector and the print unit are disposed in this order along the medium conveyance path of the medium from an upstream direction to a downstream direction of the medium, within an interior region of the image formation apparatus.

12. An image formation apparatus comprising:

a conveyance unit provided to convey a long medium provided with conveyance indexes at a predetermined conveyance index spacing;

a print unit provided to perform printing on the medium;

a cutter unit provided to cut the medium;

an index detector provided to detect the conveyance indexes;

a print controller configured to drive the print unit to perform printing in response to a detection of the conveyance indexes; and a cut controller configured to cause the cutter unit to cut the medium in response to the detection of the conveyance indexes, wherein the print controller is configured to, during a period from reception of a cut request of the medium to a completion of the cut of the medium, set a virtual conveyance index in response to the cut request and perform a cutting operation by the cut controller based on the virtual conveyance index.

13. The image formation apparatus according to claim 12, wherein the print controller starts printing on the medium at a print start position determined based on a position of the conveyance index.

14. The image formation apparatus according to claim 12, wherein the conveyance indexes include virtual conveyance indexes, and wherein the cut controller cuts the medium at a cut position determined based on a position of the virtual conveyance indexes.

15. The image formation apparatus according to claim 14, wherein a spacing of the virtual conveyance indexes is equal to the conveyance index spacing.

16. The image formation apparatus according to claim 14, wherein a spacing of the virtual conveyance indexes is set to an average value of conveyance-index-spacing monitor variables at times of detections of the previous conveyance indexes.

17. The image formation apparatus according to claim 14, wherein each of the virtual conveyance indexes is determined based on the previous conveyance indexes.

18. The image formation apparatus according to claim 12, wherein the index detector is disposed downstream of the cutter unit on a medium conveyance route.

* * * * *